US008121320B2

(12) United States Patent
Sjursen et al.

(10) Patent No.: US 8,121,320 B2
(45) Date of Patent: Feb. 21, 2012

(54) HEARING AID

(75) Inventors: Walter P. Sjursen, West Windsor, NJ (US); Michael DeSalvo, Princeton, NJ (US); Hassan A. Mohamed, Bayonne, NJ (US); Alyssa R. Needleman, San Diego, CA (US); Paul J. Mulhauser, New York, NY (US); Karl D. Kirk, III, New York, NY (US); Lyndon Treacy, Long Island City, NY (US); Kyungmin Andy Lee, Wyckoff, NJ (US)

(73) Assignee: Songbird Hearing, Inc., North Brunswick, NJ (US)

( * ) Notice: Subject to any disclaimer, the term of this patent is extended or adjusted under 35 U.S.C. 154(b) by 891 days.

(21) Appl. No.: 12/147,113

(22) Filed: Jun. 26, 2008

(65) Prior Publication Data

US 2009/0180653 A1 Jul. 16, 2009

Related U.S. Application Data

(60) Provisional application No. 61/010,748, filed on Jan. 11, 2008.

(51) Int. Cl.
*H04R 25/00* (2006.01)

(52) U.S. Cl. ..... 381/312; 381/322

(58) Field of Classification Search ..... 381/312, 381/322, 324, 328

See application file for complete search history.

(56) References Cited

U.S. PATENT DOCUMENTS

| | | | |
|---|---|---|---|
| 3,983,336 | A | 9/1976 | Malek et al. |
| D280,022 | S | 8/1985 | Egan et al. |
| 4,727,582 | A | 2/1988 | de Vries et al. |
| D297,979 | S | 10/1988 | Voroba et al. |
| 4,783,816 | A | 11/1988 | Buttner et al. |
| D322,126 | S | 12/1991 | van Mouik |
| D322,319 | S | 12/1991 | van Mourik |
| D322,481 | S | 12/1991 | van Mourik |
| D354,568 | S | 1/1995 | Araki et al. |
| D367,113 | S | 2/1996 | Weeks |
| D375,556 | S | 11/1996 | Narisawa et al. |
| 5,606,621 | A | 2/1997 | Reiter et al. |
| D385,036 | S | 10/1997 | Nielsen |
| D397,796 | S | 9/1998 | Yabe et al. |
| 6,275,596 | B1 | 8/2001 | Fretz et al. |
| 6,418,230 | B1 | 7/2002 | McDonald et al. |

(Continued)

FOREIGN PATENT DOCUMENTS

DE 27 21 469 A1 11/1978

(Continued)

OTHER PUBLICATIONS

Notification Concerning Transmittal of International Preliminary Report on Patentability, dated Jul. 22, 2010, for International Application No. PCT/US2009/000089, consisting of 7 pages.

(Continued)

*Primary Examiner* — Jasmine Clark

(74) *Attorney, Agent, or Firm* — Hamilton, Brook, Smith & Reynolds, P.C.

(57) ABSTRACT

A hearing aid includes a first portion adapted for behind-the-ear placement having a microphone, a second portion adapted for in-the-canal placement having a receiver and a cable that couples the first portion to the second portion, the cable having an adjustable length.

17 Claims, 9 Drawing Sheets

U.S. PATENT DOCUMENTS

| | | | |
|---|---|---|---|
| 6,510,230 | B2 | 1/2003 | Marx |
| 6,546,110 | B1 | 4/2003 | Vonlanthen |
| 6,549,634 | B1 | 4/2003 | Vonlanthen |
| 6,625,290 | B1 | 9/2003 | Dittli |
| 6,704,423 | B2 | 3/2004 | Anderson et al. |
| 6,724,903 | B2 | 4/2004 | Niederdrank |
| 6,731,770 | B1 | 5/2004 | Vonlanthen |
| 6,735,319 | B1 | 5/2004 | Vonlanthen |
| 6,748,094 | B1 | 6/2004 | Tziviskos et al. |
| 6,775,389 | B2 | 8/2004 | Harrison et al. |
| 6,831,988 | B2 | 12/2004 | Vonlanthen |
| 6,959,097 | B1 | 10/2005 | Borowsky |
| D516,216 | S | 2/2006 | Portmann |
| 7,003,876 | B2 | 2/2006 | Crawford et al. |
| 7,016,512 | B1 | 3/2006 | Feeley et al. |
| 7,076,076 | B2 | 7/2006 | Bauman |
| 7,082,207 | B2 | 7/2006 | Rapps |
| 7,099,484 | B2 | 8/2006 | Vonlanthen |
| 7,106,873 | B1 | 9/2006 | Harrison et al. |
| 7,110,562 | B1 | 9/2006 | Feeley et al. |
| D529,612 | S | 10/2006 | Feeley et al. |
| 7,127,077 | B2 | 10/2006 | Hall et al. |
| D532,110 | S | 11/2006 | Bailey et al. |
| 7,139,404 | B2 | 11/2006 | Feeley et al. |
| 7,142,926 | B2 | 11/2006 | Crawford |
| 7,155,023 | B2 | 12/2006 | Dittli |
| 7,167,572 | B1 | 1/2007 | Harrison et al. |
| 7,221,770 | B2 | 5/2007 | Fickweiler et al. |
| D546,455 | S | 7/2007 | Darbut et al. |
| D558,880 | S | 1/2008 | Le |
| D562,983 | S | 2/2008 | Jurkiewicz |
| 7,421,086 | B2 | 9/2008 | Bauman et al. |
| D578,639 | S | 10/2008 | Falco |
| D579,567 | S | 10/2008 | Pedersen |
| D587,249 | S | 2/2009 | Densho |
| D605,292 | S | 12/2009 | Sjursen et al. |
| D605,769 | S | 12/2009 | Sjursen et al. |
| 7,844,065 | B2 * | 11/2010 | von Dombrowski et al. . 381/328 |
| 2004/0047481 | A1 | 3/2004 | Bauman |
| 2004/0047482 | A1 | 3/2004 | Bauman |
| 2004/0047483 | A1 | 3/2004 | Bauman |
| 2005/0078843 | A1 | 4/2005 | Bauman |
| 2007/0036374 | A1 | 2/2007 | Bauman et al. |
| 2007/0127757 | A2 | 6/2007 | Darbul et al. |

FOREIGN PATENT DOCUMENTS

| | | | |
|---|---|---|---|
| DE | 10 2005 006 404 | B3 | 8/2006 |
| EP | 1 448 014 | A1 | 8/2004 |
| EP | 1 681 904 | A1 | 7/2006 |

OTHER PUBLICATIONS

SeboTek Dispenser Guide, "PAC Hearing System Voice-Q Series," 14 pages, published 2003.

International Search Report, PCT/US2009/000089, mailing date Apr. 7, 2009.

* cited by examiner

HEARING AID

RELATED APPLICATION

This application claims the benefit of U.S. Provisional Application No. 61/010,748, filed on Jan. 11, 2008. The entire teachings of the above application are incorporated herein by reference.

BACKGROUND

In behind-the-ear (BTE) hearing aids, a cable connects a BTE unit to an earpiece unit via a plastic tube, through which the wires are routed. The plastic tube is preformed for either the left or right ear, and comes in different lengths (for example: small, medium and long) to accommodate different ear sizes. The cable/earpiece is generally attached to the BTE unit using an ultra-miniature electrical connector. The receiver earpiece fits in the ear canal in either an open or closed configuration. A hearing instrument professional is needed to select the cable for the user's right or left ear, create an earmold of the user's ear canal if the configuration is closed, determine the correct length cable for the user's ear, and attach the cable/earpiece to the main unit. The user typically is not given multiple cable/earpieces; if the user wishes to change the length or switch the hearing aid from one ear to the other, the user must return to the hearing instrument professional for service.

SUMMARY

The problems and shortcomings noted above are overcome by embodiments of the present invention. Accordingly, an embodiment of a hearing aid comprises a first portion adapted for behind-the-ear placement having at least a microphone, a second portion adapted for in-the-canal placement having at least a receiver, and a cable that couples the first portion to the second portion, the cable having an adjustable length.

An example hearing aid may include an enclosure adapted for behind-the-ear placement that houses a microphone for converting an acoustical input signal to an electrical signal and a sound processing circuit for processing the electrical signal; an earpiece adapted for in-the-canal placement that includes a receiver for converting the processed electrical signal to an acoustical output signal; a battery for powering the microphone, sound processing circuit and receiver; and an electrical cable that electrically couples the processed electrical signal from the sound processing circuit to the receiver, the cable extending from the enclosure with an adjustable length. The cable may be flexible to accommodate left/right usage.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION

Figure 1:
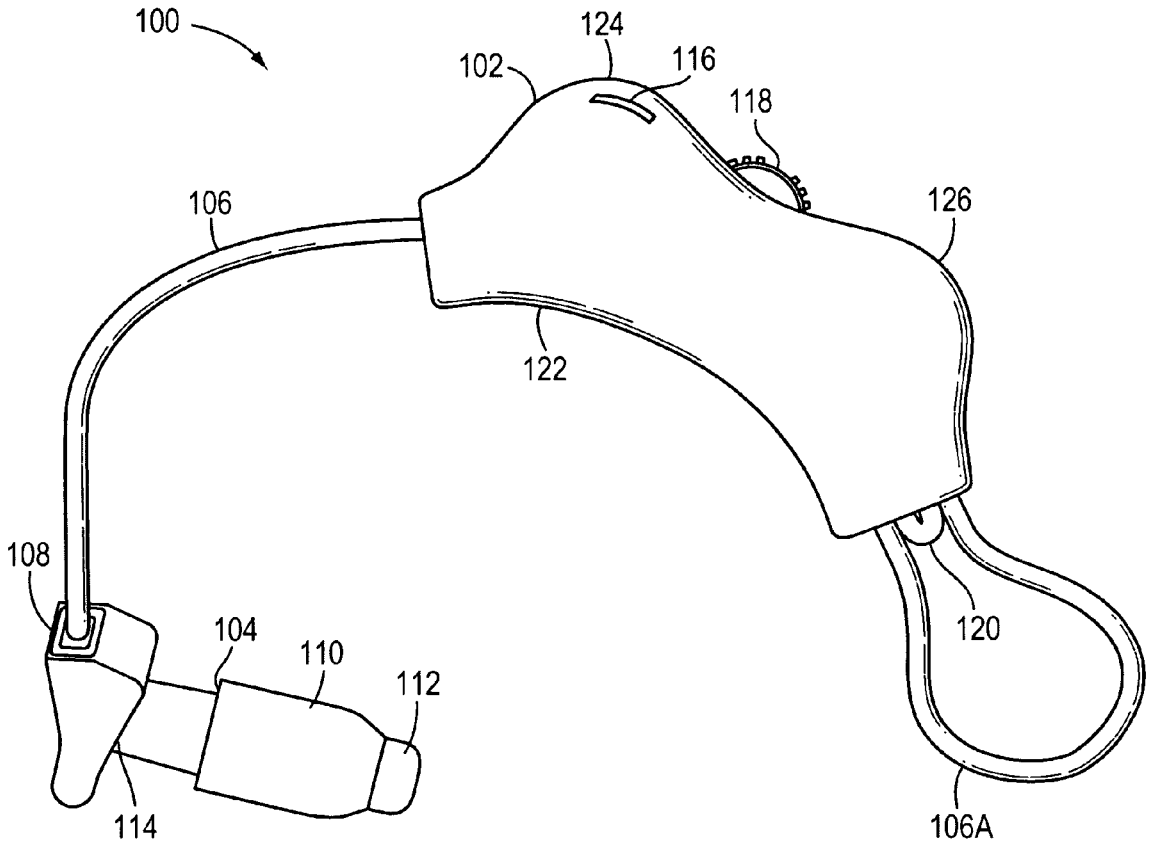
FIG. 1 illustrates a side perspective first embodiment of a hearing aid.

A first embodiment of a hearing aid shown in FIG. 1 comprises an enclosure 102, an earpiece 104 and a cable 106. The enclosure 102 houses a microphone, sound processing circuitry, a battery (shown in FIG. 4A) and an on/off volume switch 118 that controls the gain of the microphone and the sound processing circuitry. The cable 106 connects signals from the enclosure 102 to a receiver (shown in FIG. 4B) in the earpiece 104.

In an embodiment, the cable 106 runs through the body of the enclosure 102, and then loops back into the enclosure, forming a loop 106A. The cable 106 may be pulled through the enclosure 102 in either direction to either lengthen or shorten the distance between the enclosure and the earpiece 104. A stop 120 at one end of the enclosure 102 provides a minimum radius for the cable 106A and prevents the cable 106A from being pulled too far into the enclosure.

The cable 106 has electrical wires that may be molded into clear insulation, e.g., clear silicone. The wires may be stranded to provide flexibility and durability. In some embodiments, the wire gauge and stranding configuration may be selected to provide a measure of formability to accommodate forming the cable for sizing and user comfort. A clear insulation allows the skin tones to show through, thereby making the cable less visible. In some embodiments, rounded or other cross-sectional shapes may be used for the cable 106. Silicone is a good material to use since it is biocompatible and also provides sufficient friction against the skin to help prevent the hearing aid enclosure 102 from sliding. In some embodiments, other insulation materials (including, but not limited to, polyvinyl chloride, polyurethane, or other thermoplastic elastomers) or colors may be used.

The enclosure 102 may be made of a plastic or other lightweight material. The enclosure 102 is generally oblong in shape with a curved bottom surface 122 and lobes 124, 126.

Embodiments of the hearing aid may be used on either the left or right ear. Since the cable 106 is flexible, the earpiece 104 may be twisted in the correct direction to be inserted into the ear. On the enclosure 102, an acoustical sound port 116 channels sound to the microphone. The sound port 116 may be located along a symmetrical or almost symmetrical axis to provide proper sound pickup regardless of which ear the hearing aid is being worn on. Therefore, the same hearing aid may be used for either ear.

The earpiece 104 comprises a receiver (shown in FIG. 4B), handle 108, tip 110, wax guard 112 and receiver holder 114. The receiver is mounted in the receiver holder 114. The tip 110 may be made of a soft material, preferably silicon. An optional wax guard 112 made of reticulated foam may be attached to the tip 110. Other types of wax guards may be used.

The handle 108 generally forms a T-shape with the receiver holder 114. The handle 108 and the receiver holder 114 may be made of plastic, for example acrylonitrile butadiene styrene (ABS). Other types of materials may be used. The surface of handle 108 may be curved to better conform to the shape of a user's finger and angled away from the tip to provide a measure of strain relief for the cable 106 that connects to the receiver through a top portion of the handle 108. In some embodiments, the connection between the cable 106 and the handle 108 may include a connector/receptacle configuration (e.g., an ultra-miniature electrical connector).

The handle 108 further provides a means for the user to insert the earpiece 104 to a proper and consistent depth within the ear canal. In particular, the handle 108 may be sized to prevent the tip 110 from touching the bony portion of the user's ear canal. Additionally, the handle 108 may prevent the user from inserting the tip 110 too deeply into the ear canal so as to avoid injury to the tympanic membrane.

Figure 2:
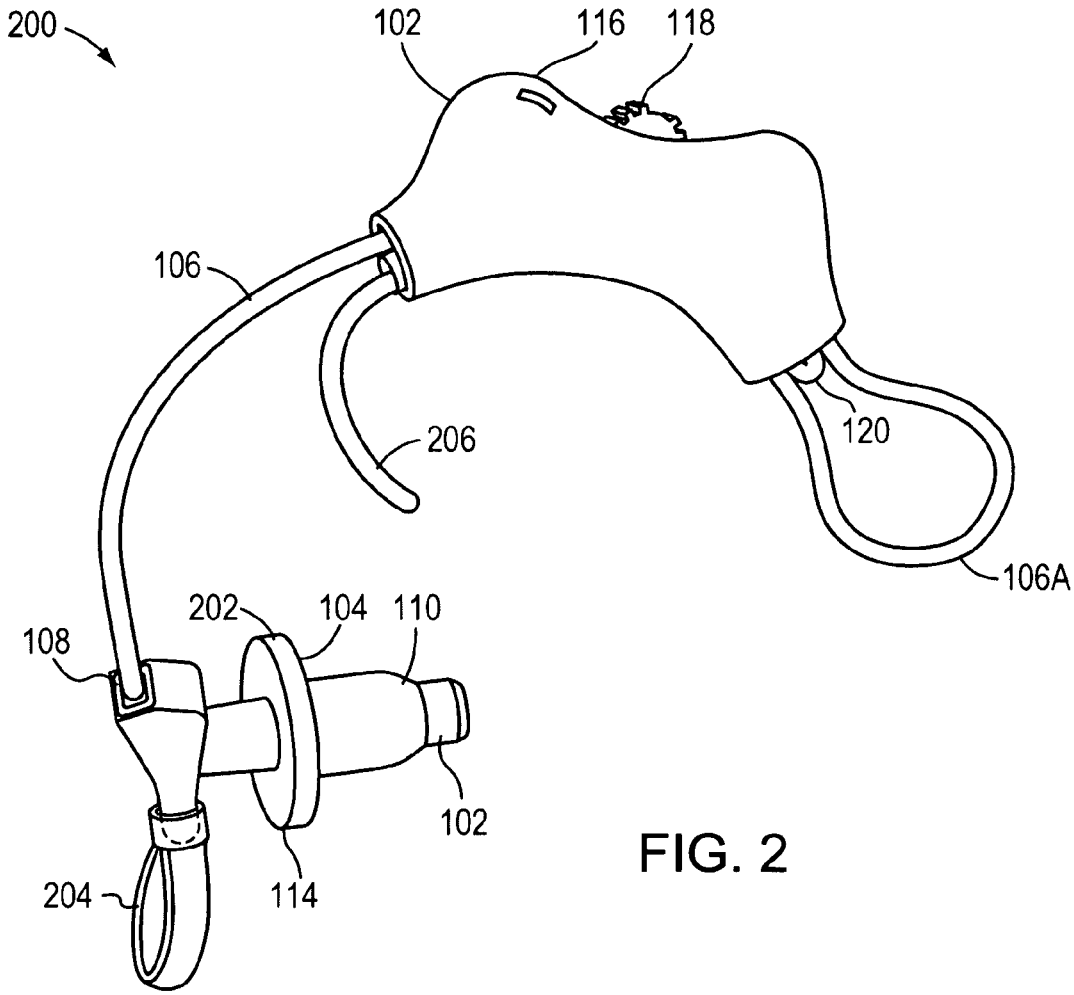
FIG. 2 illustrates the embodiment of FIG. 1 with additional disk, ear-hook and retention elements.

FIG. 2 illustrates the hearing aid of FIG. 1 with additional optional elements, including a disk element 202, a retention element 204 and an ear hook element 206.

The optional disk element 202 may be positioned around the receiver holder 114 between the handle 108 and the tip 110 of the earpiece 104. The disk element 202 may be made of a foam or other suitable material. The disk element 202 absorbs sound and helps avoid feedback between the microphone and the receiver. In addition, the disk element 202 helps to retain the earpiece 104 in the ear canal.

The optional retention cord or loop element 204 may be attached to the handle 108 and positioned in the concha of the pinna to help retain the earpiece 104 in the ear canal. The retention element 204 may be sized for different sized ears. The retention element 204 may be optionally attached and detached by the user, or may be permanently attached at the time of manufacture.

The optional ear hook 206 is attachable to the enclosure 102 to help position the enclosure 102 relative to the user's ear. The ear hook 206 may be optionally attached and detached by the user, or may be permanently attached at the time of manufacture.

Figure 3:
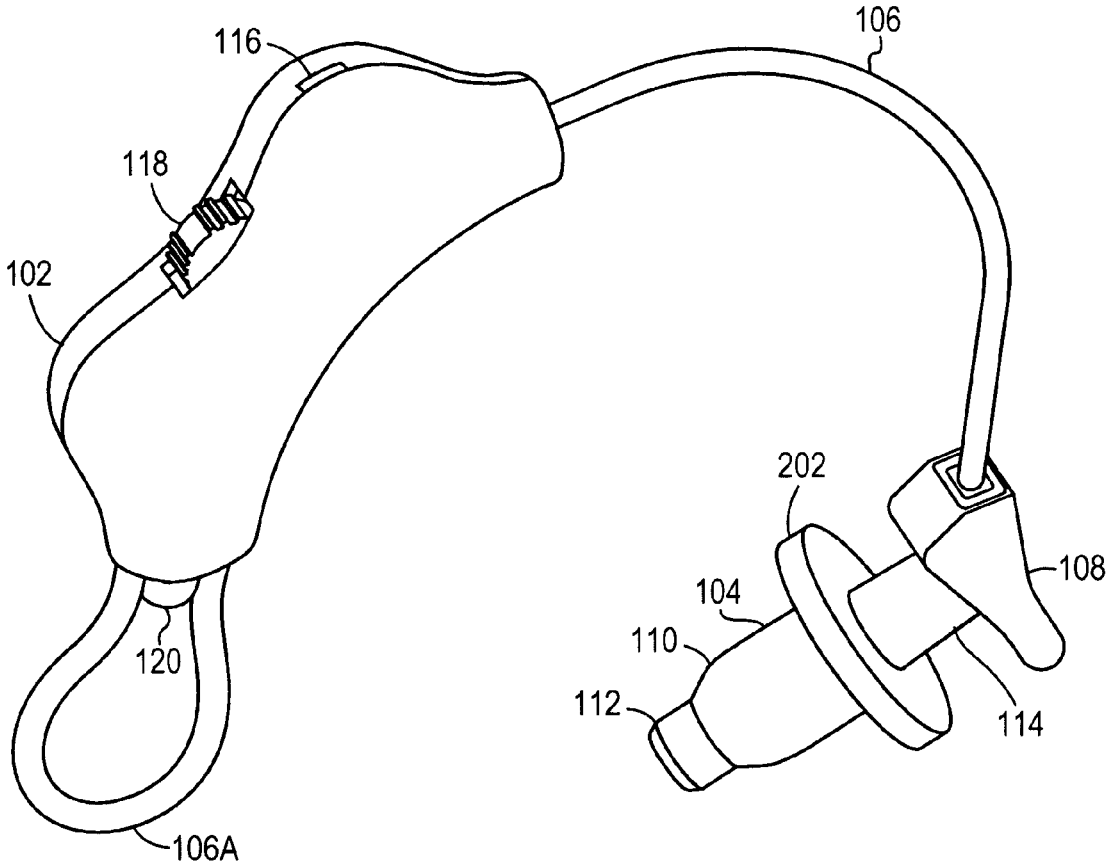
FIG. 3 is an opposite side perspective view of the embodiment of FIG. 1 with the foam disk element.
Figure 4A:
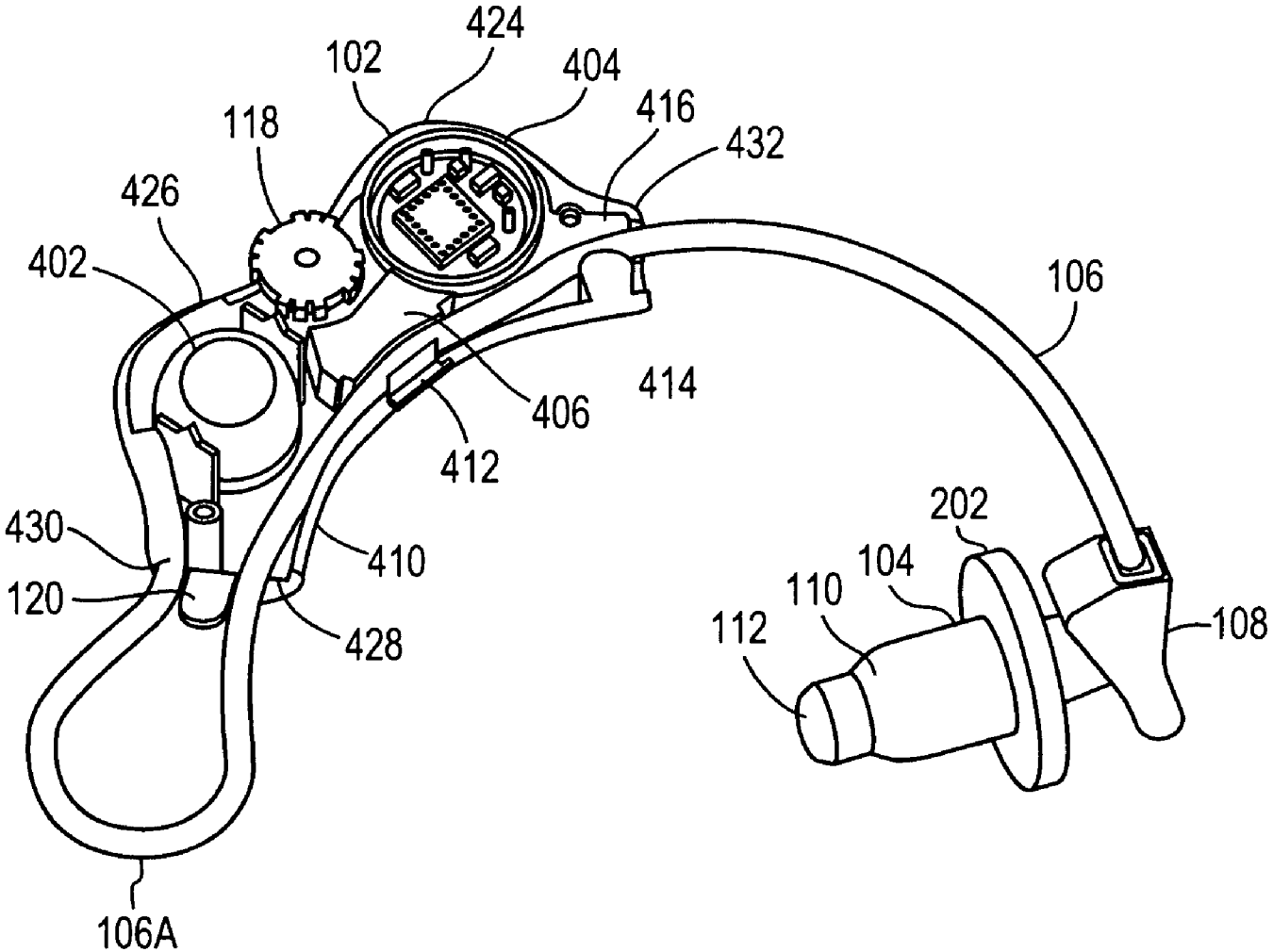
FIG. 4A illustrates a half shell assembly view of the embodiment of FIG. 1 with the foam disk element.

FIG. 3 is an opposite side perspective view of the embodiment of FIG. 1 with the foam disk element 202 in place. FIG. 4A illustrates a half shell assembly view of the embodiment of FIG. 1. In this view, one half of the enclosure 102 has been removed to show battery 402 and microphone and sound processing circuitry 404. The battery 402 is mounted in a recess 426. The microphone and sound processing circuitry 404 are mounted in a recess 424. The on/off volume switch 118 is mounted between the recesses 424, 426. A printed circuit board (not shown) provides electrical connections between the battery 402, microphone and sound processing circuitry 404 and the on/off volume switch 118.

The enclosure 102 has openings 428, 430 at one end through which the adjustable cable loop 106A passes. The cable 106 passes through opening 432 at the other end of the enclosure 102.

In an embodiment, the cable 106 may be held in its position by friction between the cable and the enclosure 102. As shown in FIG. 4A, a compliant element 406 may be positioned between a portion of the cable 106 and a guide 412 in the enclosure 102 to provide a force against the cable 106 as a means of friction. The compliant element 406 may be one of a piece of foam, a plastic spring, a metal spring, or other means of providing a force. In another embodiment, frictional force is provided by routing the cable 106 through a slightly torturous path or through a pinch-point, such that the cable rubbing on one or more guides 410, 414, 416 in the enclosure creates the friction. The cable 106 may be further guided along a channel formed by the guides 410, 414, 416. In other embodiments, other means, either continuously adjustable or discretely adjustable, may be used to adjust and maintain the length (e.g., sprockets, press-fit means, pin-and-hole like a belt adjustment, etc.).

Figure 4B:
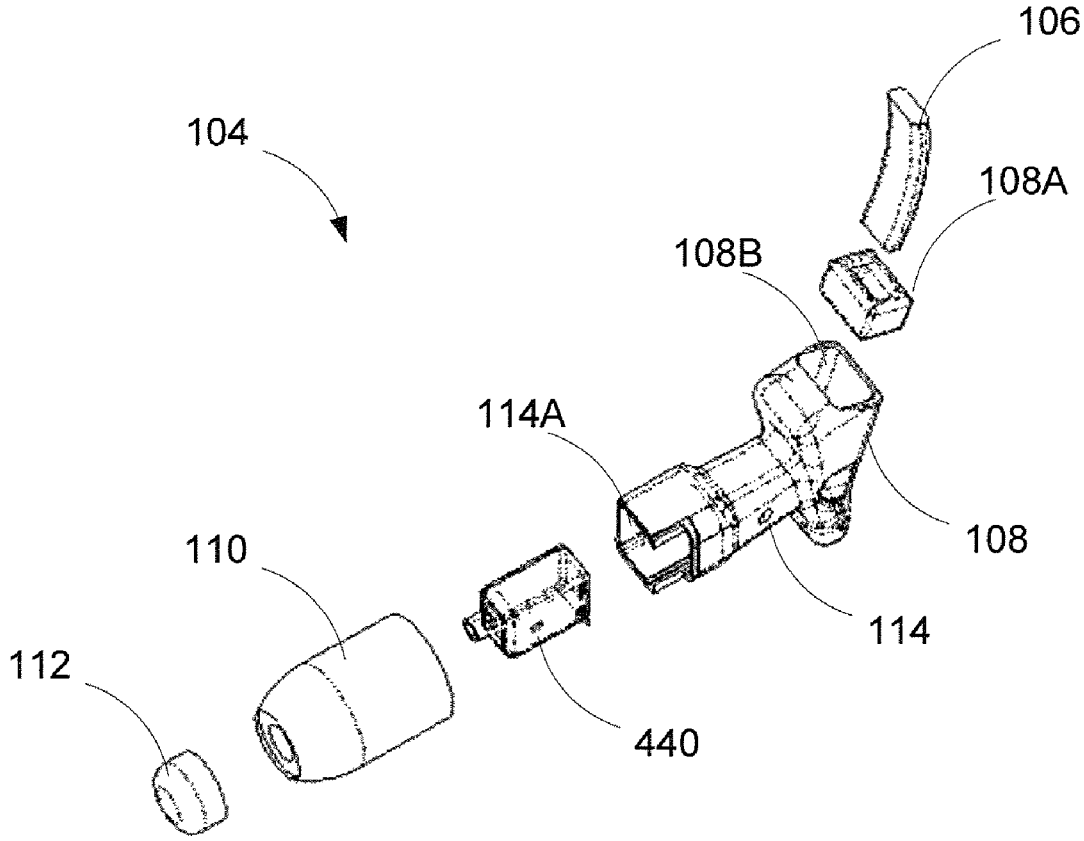
FIG. 4B is an exploded view of an earpiece for the embodiment of FIG. 1.

FIG. 4B is an exploded view of an example earpiece 104. Receiver 440 may be mounted in opening 114A of receiver holder 114. Cable 106 may be received through strain relief element 108A which fits in opening 108B of handle 108.

Figure 5:
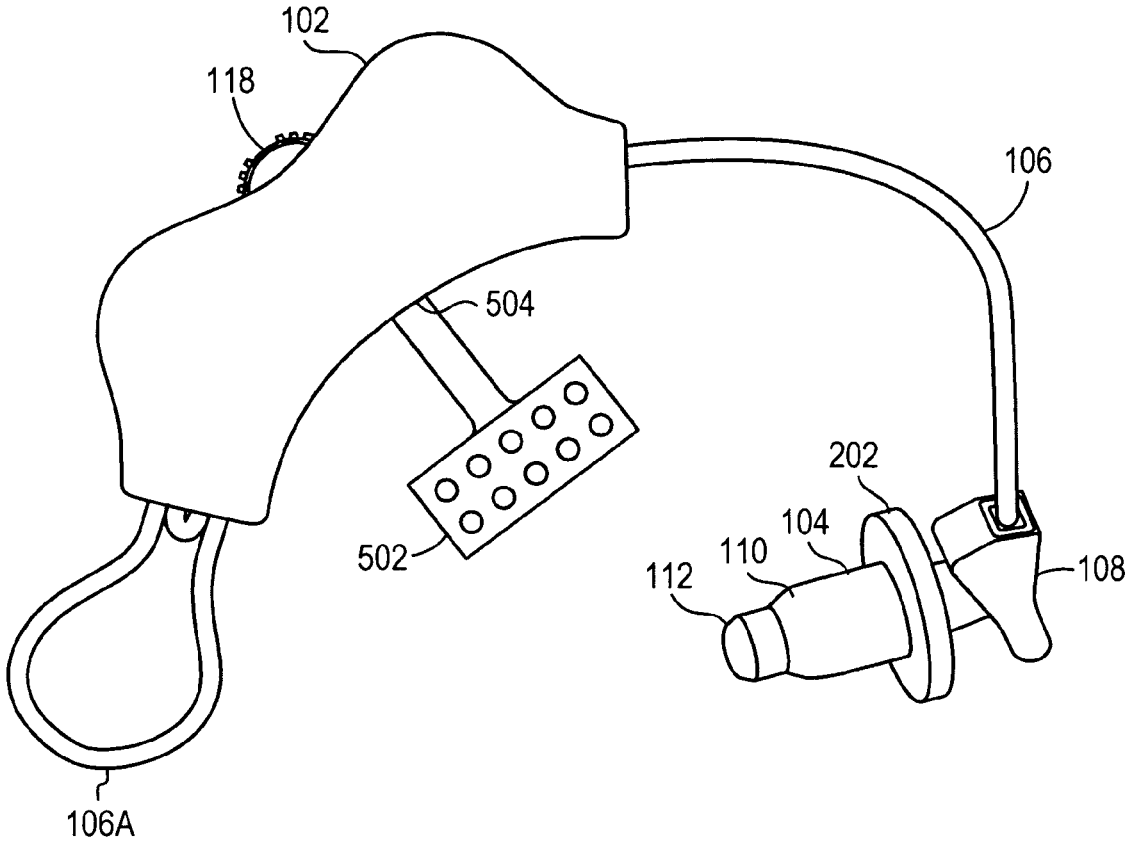
FIG. 5 illustrates an opposite side view of the embodiment of FIG. 1 with a test pad/programming element.

FIG. 5 illustrates the embodiment of FIG. 1 with a test pad/programming element 502 that extends through an opening 504 of the enclosure 102. The test pad/programming element 502 provides electrical access to the electronic circuitry of the hearing aid for the purposes of testing and programming features.

Figure 6:
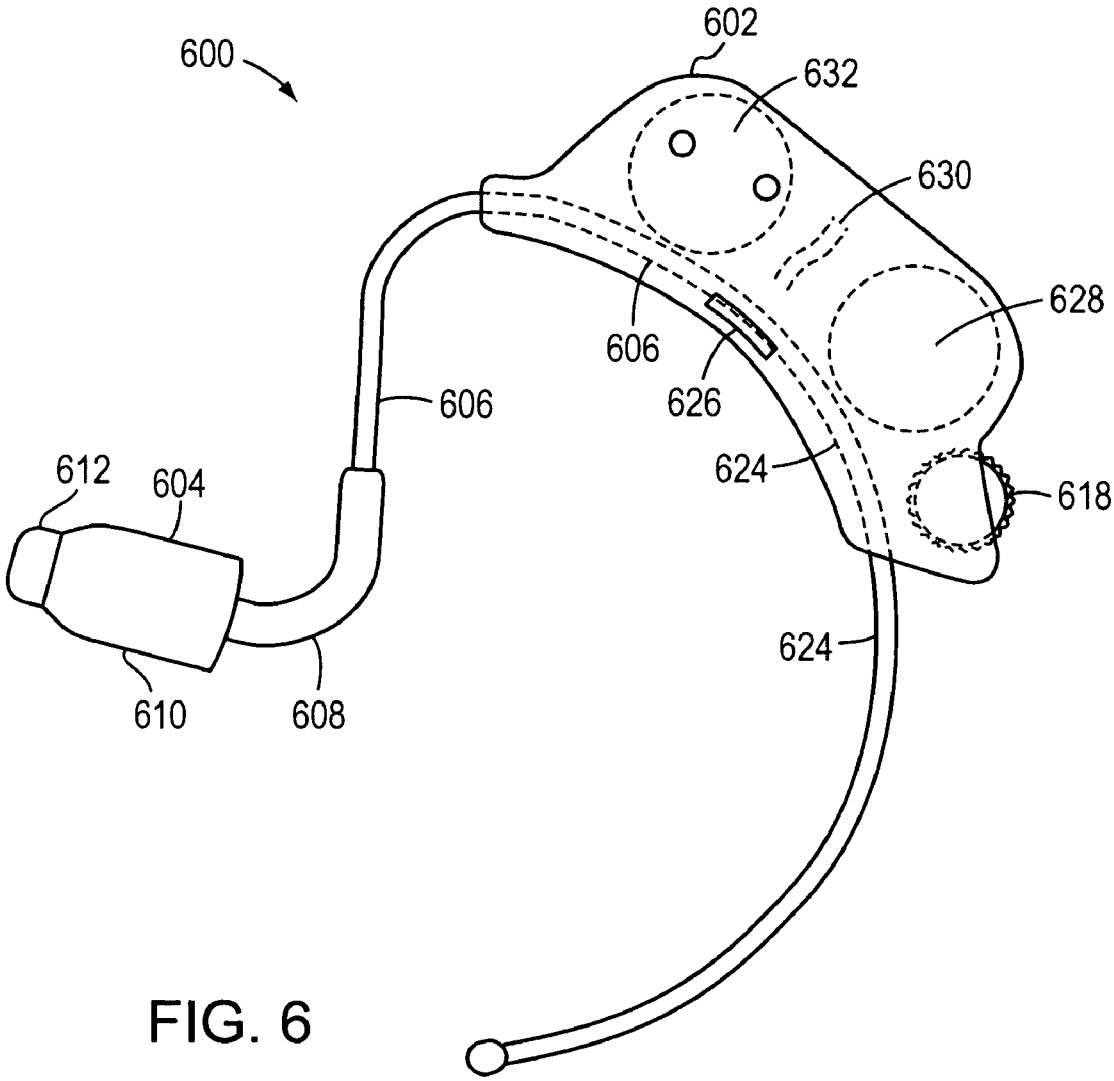
FIG. 6 illustrates a second embodiment of a hearing aid.

In a second embodiment of a hearing aid 600 shown in FIG. 6, the wires do not loop outside the body of the enclosure; rather, the wires split off within the enclosure 602 and a tail portion 624 extends from the enclosure to aid in adjusting length. In this embodiment, the earpiece 604 is attached with a flexible wire 606 up to the point of a coupler 626 located intermediate the enclosure 602. The wires then exit the coupler 626 and are soldered to a printed circuit board (not shown) within the enclosure. The wires have sufficient slack 630 (excess wire) to allow adjustment of the length between the enclosure 602 and the earpiece 604. A semi-flexible cord (or tail) 624 exits the other end of the coupler 626 and out from the enclosure 602. The user may use the tail 624 to push or pull the coupler 626, which in turn adjust the length between the earpiece 604 and the enclosure 602. Since the tail 624 does not contain any wiring, it may be cut by the user to a desired length. The tail 624 is also curved inwards toward the ear, and may help in retaining the hearing aid on the user's ear.

The enclosure 602 houses microphone and sound processing circuitry 628, battery 632 and includes on/off volume control switch 618. The earpiece 604 includes elbow-shaped handle 608, tip 610 and wax guard 612. The handle 608 may be rotated about the cable 606 to accommodate left/right usage.

Figure 7:
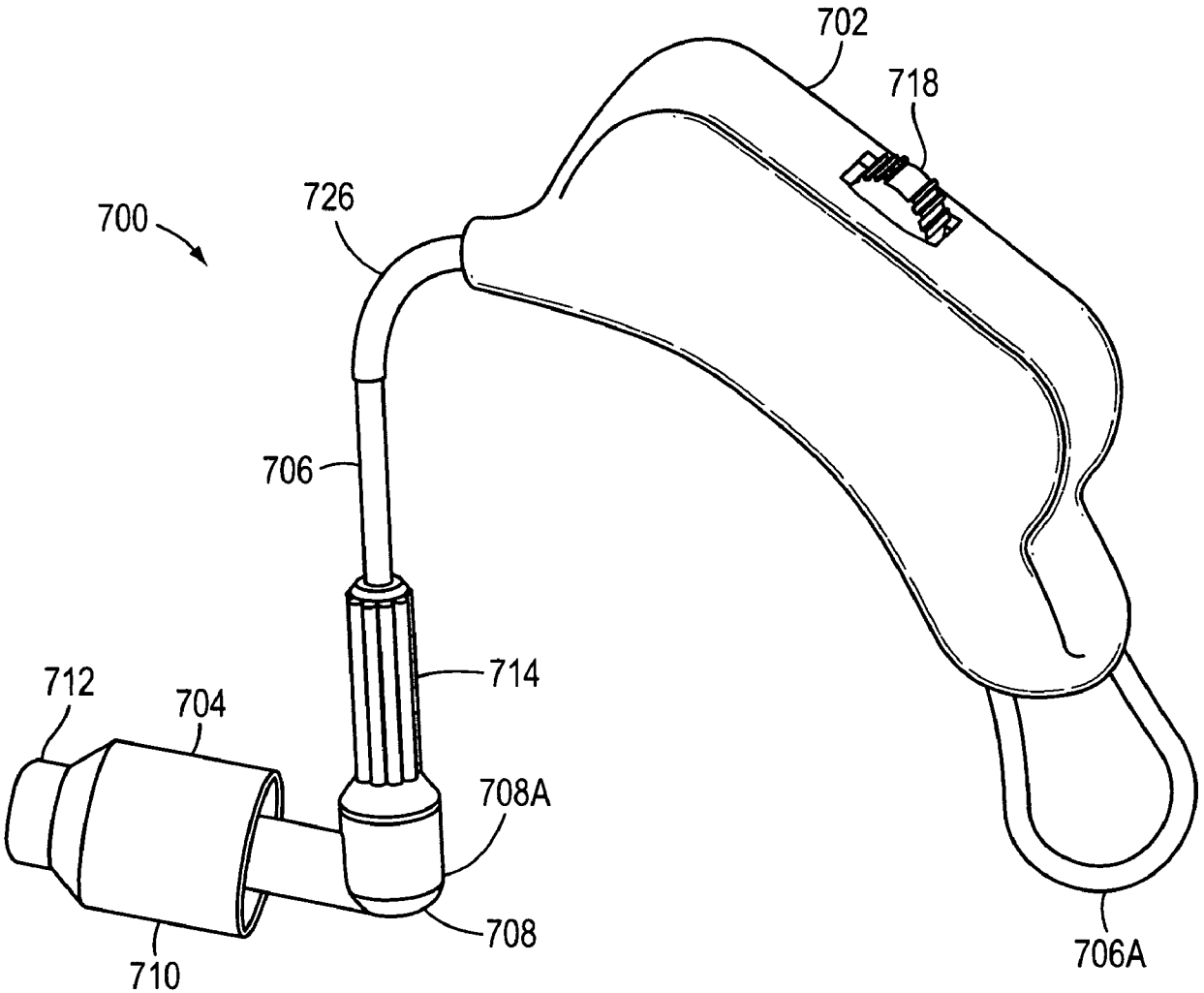
FIG. 7 illustrates a third embodiment of a hearing aid.

FIG. 7 illustrates a third embodiment of a hearing aid 700. This embodiment is similar to the first embodiment in that the cable 706A is looped through the enclosure 702 to allow adjustment of the cable length. The enclosure 702 includes on/off volume control switch 718, battery and microphone/sound processing circuitry (not shown). A tubing sleeve 726 provides an over-ear hook for retention and positioning of the hear aid. Earpiece 704 includes handle 708, tip 710 and wax guard 712. The cable 706 slides in and out of tubing sleeve 726 to allow for an adjustable length. Handle 708 is rotatable about another tubing sleeve 714 that locks position at the end of travel for left/right usage.

In some embodiments, the hearing aid is fully disposable, in that the battery is integral to the hearing aid and is not replaceable by the user. Therefore, when the battery is depleted, the entire hearing aid may be discarded. In a partially disposable embodiment, the earpiece comprises at least a battery, receiver, cable and means of connection to the enclosure containing microphone and sound processing circuitry. When the battery is depleted, the earpiece is replaced with a new earpiece while the enclosure containing the microphone and sound processing circuitry may be reused.

Figure 8:
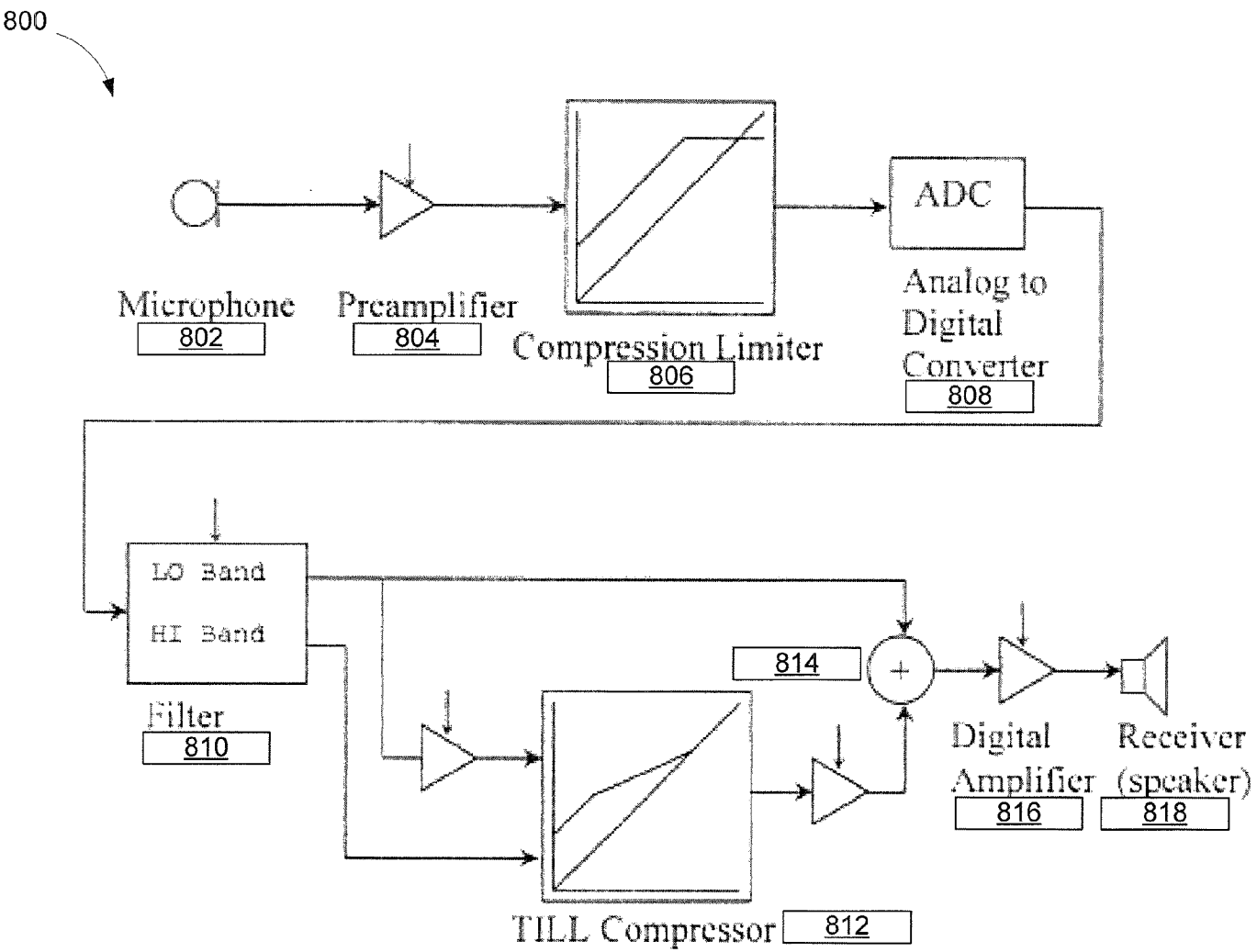
FIG. 8 illustrates an embodiment of a circuit block diagram for a hearing aid.

FIG. 8 shows an example circuit block diagram for use in any of the hearing aid embodiments described herein. The hearing aid circuit 800 includes a microphone 802, sound processing circuitry 804, 806, 808, 810, 812, 814, 816 and a receiver/speaker 818. A battery not shown supplies power to the circuitry 800. Sound is received by the microphone 802 and converted into an electrical signal. A preamplifier 804 amplifies the signal to appropriate levels within the circuit. The preamplifier 804 also has a programmable gain function and is programmed to compensate for tolerances in the microphone sensitivity. The signal then passes through a compression limiter circuit 806 that prevents loud sounds from overloading the circuit's signal path. Following the compression limiter 806 is an analog-to-digital converter (ADC) 808. While different types of ADCs may be used, some embodiments use a sigma-delta modulator based converter. The ADC 808 converts the analog signal into its digital representation. The digital signal then passes through a filter bank 810. In the embodiment shown, a two-band filter is employed. In other embodiments, the filter bank may use more than two filter bands. The outputs from the filter bank 810 pass through another compression circuit 812 that is configured to provide a Treble-Increase-at-Low-Levels (TILL) function. The output of the TILL compressor 812 is summed 814 with a fraction of the LO-band output from the filter bank 810, and then is processed by a digital amplifier 816. In an embodiment, the digital amplifier 816 is another sigma-delta modulator. This digital amplifier 816 also has programmable gain, used to compensate for tolerances of the receiver (speaker) sensitivity. The output of the digital amplifier 816 drives the receiver 818 that converts the digital signal back into sound.

More complex or less complex sound processing circuitry may be used with example embodiments.

While this invention has been particularly shown and described with references to example embodiments thereof, it will be understood by those skilled in the art that various changes in form and details may be made therein without departing from the scope of the invention encompassed by the appended claims.

What is claimed is:

1. A hearing aid comprising:

a first portion adapted for behind-the-ear-placement having at least a microphone;

a second portion adapted for in-the-canal placement having at least a receiver;

a battery for powering the hearing aid; and a cable that couples the first portion to the second portion, the cable having an adjustable length wherein the cable adjustably slides through in one direction to lengthen, and in an opposite direction to shorten, a distance between the first portion and the second portion and loops back into the first portion.

2. The hearing aid of claim 1 wherein the battery is located in the first portion and is non-replaceable.

3. A hearing aid comprising:

a first portion adapted for behind-the-ear-placement having at least a microphone;

a second portion adapted for in-the-canal placement having at least a receiver and a battery wherein the second portion is replaceable; and a cable that couples the first portion to the second portion, the cable having an adjustable length.

4. A hearing aid comprising:

an enclosure adapted for behind-the-ear placement that houses a microphone for converting an acoustical input signal to an electrical signal and a sound processing circuit for processing the electrical signal;

an earpiece adapted for in-the-canal placement that includes a receiver for converting the processed electrical signal to an acoustical output signal;

a battery for powering the microphone, sound processing circuit and receiver; and an electrical cable that electrically couples the processed electrical signal from the sound processing circuit to the receiver, the cable extending from the enclosure with an adjustable length wherein the cable adjustably slides through in one direction to lengthen, and in an opposite direction to shorten, a distance between the earpiece and the enclosure and loops back into the enclosure.

5. The hearing aid of claim 4 further comprising a stop extending from the enclosure that provides a minimum radius for the looped cable portion.

6. The hearing aid of claim 4 wherein the earpiece includes a receiver holder element for holding the receiver and a handle element for gripping the earpiece.

7. The hearing aid of claim 6 wherein the earpiece further includes a retention element removably connected to the handle element configured for retaining the earpiece.

8. The hearing aid of claim 6 wherein the earpiece includes a disk element positioned on the receiver holder element that absorbs sound.

9. The hearing aid of claim 4 further comprising an ear hook extending from the enclosure for retaining the enclosure in position.

10. The hearing aid of claim 4 wherein the enclosure includes a sound port for directing acoustical energy to the microphone.

11. The hearing aid of claim 10 wherein the sound port is located along a symmetrical axis of the enclosure.

12. The hearing aid of claim 4 wherein the enclosure includes a friction element for frictionally holding the cable in position.

13. The hearing aid of claim 4 wherein the battery is located in the enclosure and is non-replaceable.

14. The hearing aid of claim 4 wherein the battery is located in the earpiece and the earpiece is replaceable.

15. A hearing aid comprising:

an enclosure adapted for behind-the-ear placement that houses a microphone for converting an acoustical input signal to an electrical signal and a sound processing circuit for processing the electrical signal;

an earpiece adapted for in-the-canal placement that includes a receiver for converting the processed electrical signal to an acoustical output signal;

a battery for powering the microphone, sound processing circuit and receiver; and an electrical cable that electrically couples the processed electrical signal from the sound processing circuit to the receiver, the cable extending from the enclosure with an adjustable length wherein the cable is flexible allowing the earpiece to be twisted for placement in either the left or right ear.

16. The hearing aid of claim 4 wherein the cable comprises clear insulation.

17. The hearing aid of claim 4 wherein the cable is formable.

* * * * *